US005944032A

United States Patent [19]

Masterson

[11] Patent Number: 5,944,032

[45] Date of Patent: Aug. 31, 1999

[54] SQUEEZABLE CLEANSING AND LATHERING DEVICES

[76] Inventor: Kelly Ann Masterson, 280 Ironwood La., Redding, Calif. 96003

[21] Appl. No.: 09/093,002

[22] Filed: Jun. 8, 1998

Related U.S. Application Data

[60] Provisional application No. 60/049,028, Jun. 9, 1997.

[51] Int. Cl.[6] ..... A45D 27/04

[52] U.S. Cl. ..... 132/290; 30/34.05; 401/8; 401/183; 15/229.11; 15/229.13

[58] Field of Search ..... 132/289, 290; 30/34.05, 537; 401/183, 8, 138, 139; 15/229.11, 229.12, 229.13

[56] References Cited

U.S. PATENT DOCUMENTS

| | | | |
|---|---|---|---|
| 383,149 | 5/1888 | Robinson | 401/183 |
| 792,278 | 6/1905 | McCarthy | 401/183 |
| 886,984 | 5/1908 | Jopling | 401/183 |
| 1,677,954 | 7/1928 | Cleary . | |
| 1,892,836 | 1/1933 | Harvey | 132/290 |
| 2,408,860 | 10/1946 | Lindbald | 401/183 |
| 2,559,344 | 7/1951 | Cesar | 30/90 |
| 2,789,346 | 4/1957 | Algier et al. | 30/32 |
| 3,014,233 | 12/1961 | Biggons | 15/568 |
| 3,084,368 | 4/1963 | Kolk | 15/209 |
| 3,426,769 | 2/1969 | Slewing | 132/290 |
| 3,488,126 | 1/1970 | Avallone | 401/8 |
| 3,617,139 | 11/1971 | Ross | 401/206 |
| 3,870,419 | 3/1975 | Sage | 401/8 |
| 3,924,288 | 12/1975 | Breland | 15/229.11 |
| 3,985,146 | 10/1976 | Albach | 401/183 |
| 4,457,640 | 7/1984 | Anderson | 401/7 |
| 4,483,356 | 11/1984 | Kales | 132/88.7 |
| 4,542,828 | 9/1985 | Gotto | 206/581 |
| 4,674,237 | 6/1987 | Sullivan | 51/391 |
| 4,712,300 | 12/1987 | Hemmeter | 30/40 |
| 4,889,441 | 12/1989 | Tice | 401/131 |
| 4,893,371 | 1/1990 | Haartman | 15/229.11 |
| 4,953,250 | 9/1990 | Brown | 15/104.94 |
| 4,969,225 | 11/1990 | Schubert | 15/209 |
| 4,995,344 | 2/1991 | Olson | 119/85 |
| 5,019,033 | 5/1991 | Geria | 401/183 |
| 5,397,194 | 3/1995 | Yuan et al. | 401/183 |
| 5,465,452 | 11/1995 | Girardot et al. | 15/210.1 |
| 5,704,723 | 1/1998 | Salisian | 401/8 |
| 5,758,386 | 6/1998 | Chen | 15/229.11 |

FOREIGN PATENT DOCUMENTS

| | | | |
|---|---|---|---|
| 1025845 | 4/1953 | France | 401/201 |
| 578956 | 7/1958 | Italy | 401/201 |
| 137382 | 1/1920 | United Kingdom | 30/34 R |
| 2220989 | 1/1990 | United Kingdom | 132/290 |

*Primary Examiner*—Todd E. Manahan
*Attorney, Agent, or Firm*—Robert Platt Bell & Associates, PC

[57] ABSTRACT

A bladder is attached to a puff to allow even and accurate dispensing of soap or other wash products. When squeezed, liquid soap within the bladder is dispensed through a nozzle. In a second embodiment, liquid soap dispensing is accomplished by having a handle which at the end has a bladder portion. In an alternative embodiment, the present invention may also incorporate a novel means of shaving one's legs by having a receptacle at one end of the handle wherein a razor can be inserted. When a razor is inserted in the receptacle, the user can grasp the "puff end" of the handle and quickly, easily reach the extremities of the legs and shave them.

30 Claims, 8 Drawing Sheets

SQUEEZABLE CLEANSING AND LATHERING DEVICES

CROSS-REFERENCE TO RELATED APPLICATIONS

This application claims priority from Provisional U.S. application Ser. No. 60/049,028, filed Jun. 9, 1997 which is incorporated herein by reference.

FIELD OF THE INVENTION

The present invention relates to personal cleansing implements and more specifically to those wash pads made of an extruded plastic scrim which are used as a washing medium in baths and showers. These wash pads are commonly referred to as "puffs" or by various trademarks such as "Scrubbie™ and Bath Ball™.

The puffs used in combination with the present invention are generally round, typically 6"–8" in diameter and are made in a variety of colors. Puffs have become very popular in recent years due to their ability to lather up soap and gently, effectively wash a person's skin. The present invention will explain how the lathering of a puff can be improved and made far more convenient. The present invention also relates to shaving devices which improve the convenience and ease of shaving one's legs.

The result of the discoveries of the present invention as contained herein have broadened in use into other commercial and industrial uses. For instance, cleaning windshields and washing off paint over-spray on windows. It is easy to see that the uses of the present invention are not limited to just those described herein and are basically unlimited in scope in the field of cleansing.

BACKGROUND OF THE INVENTION

In the past, bathing was typically done by the use of soap being applied directly to the body or being applied by using a wash rag. Sponges have gained some popularity, but the retention of water and its potential un-hygienic effect has reduced its popularity. Similar to sponges, Loofahs have gained some popularity but many users consider them to be abrasive to the skin. A third commonly used medium is the back brush, but unfortunately it is limited solely to washing the back and is impractical for washing other parts of the body.

Puffs, on the other hand, have superior hygiene qualities since they dry out quickly after use. They are also very soft to the touch and yet have a coefficient of friction which is adequate to clean the skin effectively. It has only been in the last 6 years in which puffs have become a popular washing medium.

Bathers using prior art puffs as previously described will typically wet a puff in the shower stream or by dipping in the bath water, next apply a liquid soap, and then wash the body.

Razors used for shaving legs are commonly known and sold throughout every major U.S. retailer. When shaving legs, it can become somewhat difficult to bend over and reach the outer extremities of the legs. It can be particularly difficult in a small shower stall or a cramped tub. British patent No. 137,382 illustrates an inadequate attempt at improving the shaving process by being able to extend the reach of the razor blade by attaching it to the end of a relatively short shaving brush.

SUMMARY OF THE INVENTION

The present invention improves the ability of a bather to lather up a puff, conveniently wash the skin without excessive bending and reaching, and can allow the bather to shave her legs with a minimum of effort.

In a first embodiment, improvement in lathering is accomplished by utilizing a bladder which is attached to a puff. When squeezed, liquid soap within the bladder is dispensed through a nozzle. The user has instant control of how much soap is dispensed by simply squeezing the bladder. These bladders can be in virtually any size and shape and can be attached to a puff in a multitude of ways.

In a second embodiment, liquid soap dispensing is accomplished by having a handle which at the end has a bladder portion which functions essentially the same as the previously mentioned bladder. This bladder also has a puff attached and when squeezed soap is dispensed. The handle gives the user control over dispensing of the soap and gives added convenience to washing extremities of one's body. In this second embodiment, dispensing is controlled in much the same manner as the preceding puff.

Again, the handled bladder with its attached puff may be accomplished in a variety of ways. For instance, one variation would be to simply attach a handle to the prior mentioned bladder instead of having the bladder be a part of the handle itself.

In an alternative embodiment, the present invention may also incorporate a novel means of shaving one's legs by having a receptacle at one end of the handle wherein a razor can be inserted. When a razor is inserted in the receptacle, the user can grasp the "puff end" of the handle and quickly, easily reach the extremities of the legs and shave them. There are various ways to attach the razor, but in all cases safety should be considered. For instance, if the razor is to be kept in place permanently, a cover should be used which can easily snap atop the razor's head.

The puff's handle, when gently curved, provides additional ability and comfort in the shaving operation as well as the washing operation. Curved handles allow added access to difficult to reach spots on the body. In fact, it is easier to wash one's back with the curved handle of the present invention than with a prior art "straight handle."

By combining the above attributes, a bather may realize tremendous comfort and ease of bathing and shaving.

DETAILED DESCRIPTION OF THE INVENTION

For the purposes of the present application, the term "plastic scrim", as used in the assembly of the present invention is construed to mean the type of material commonly known and used in industry under the following names: Diamond Mesh I Polyethylene Extruded Scrim; Polyethylene/Nylon Netting; and Vexar™ (used in combination or variations with any of the preceding) . Such materials are available from Dupont of Canada (1-800-263-2742), Conwed, of Minneapolis, Minn. (1-800-426-0149), NSW of Roanoke, Va. (1-800-368-3610) or MasterNet of Canada.

Such a material comprises, generally, a tubular netting material which may be bunched up to form a puff or scrubbing ball, as noted above in the Background of the Invention. Such prior art scrubbing puffs are available as the Body Scrub Sponge, from Upper Canada Accessories, Mississauga, Canada L4X2W9, the Body Buffer, from The Body Shop, 45 Horsehill Road, Cedar Knolls, N.J., 07927-2014, the Body Sleeker, from LTK Industries, Inc., 7W Avondale Drive, Greenville, S.C., 29609, and the Net Bath Sponge, from Paris Presents, Inc., Gurness, Okla. The present invention relates to an improvement over such prior art scrubbing puffs.

Figure 1:
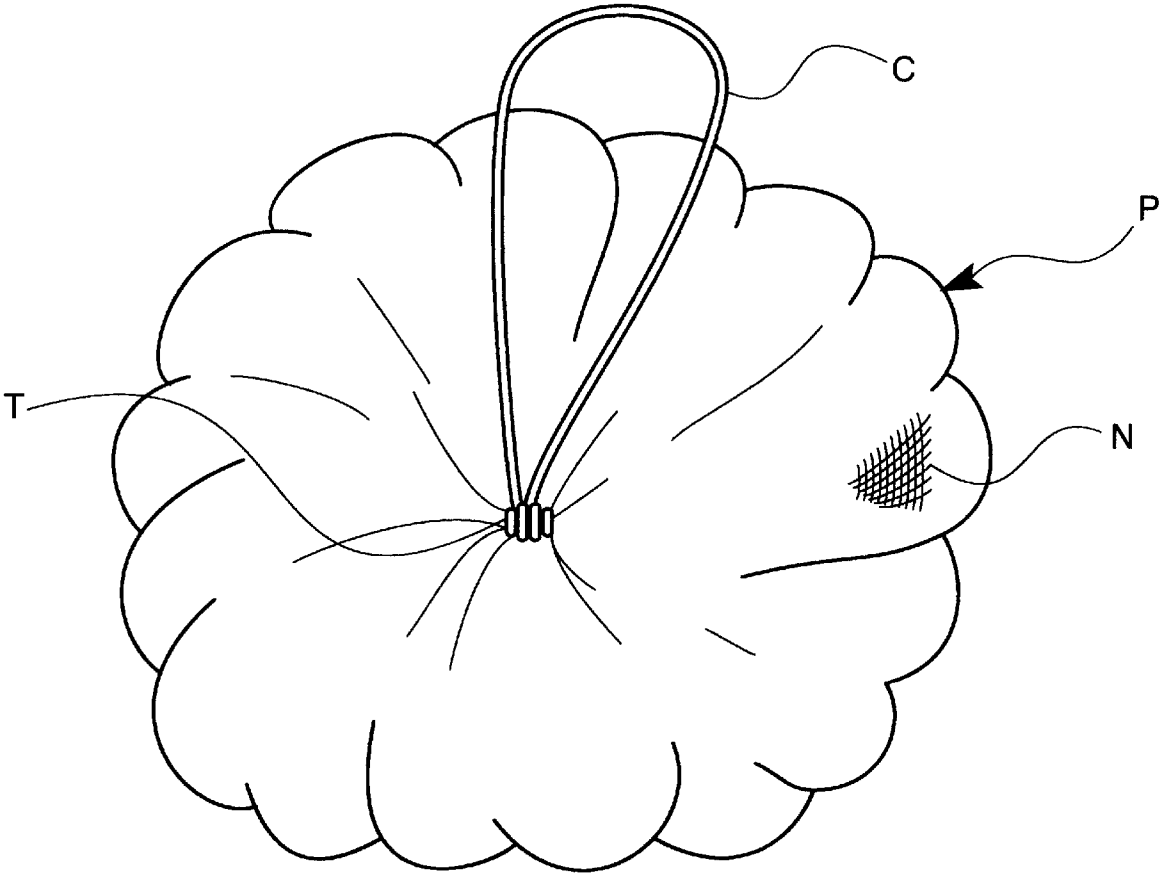
Figure 1 (Prior Art)
FIG. 1 is a Prior Art puff.

Prior art FIG. 1 shows puff P which is made from plastic scrim illustrated with cross-hatching N. The round shape of puff P is created by being tied in the middle at T, in which a loop cord C may or may not be attached.

Figure 2:
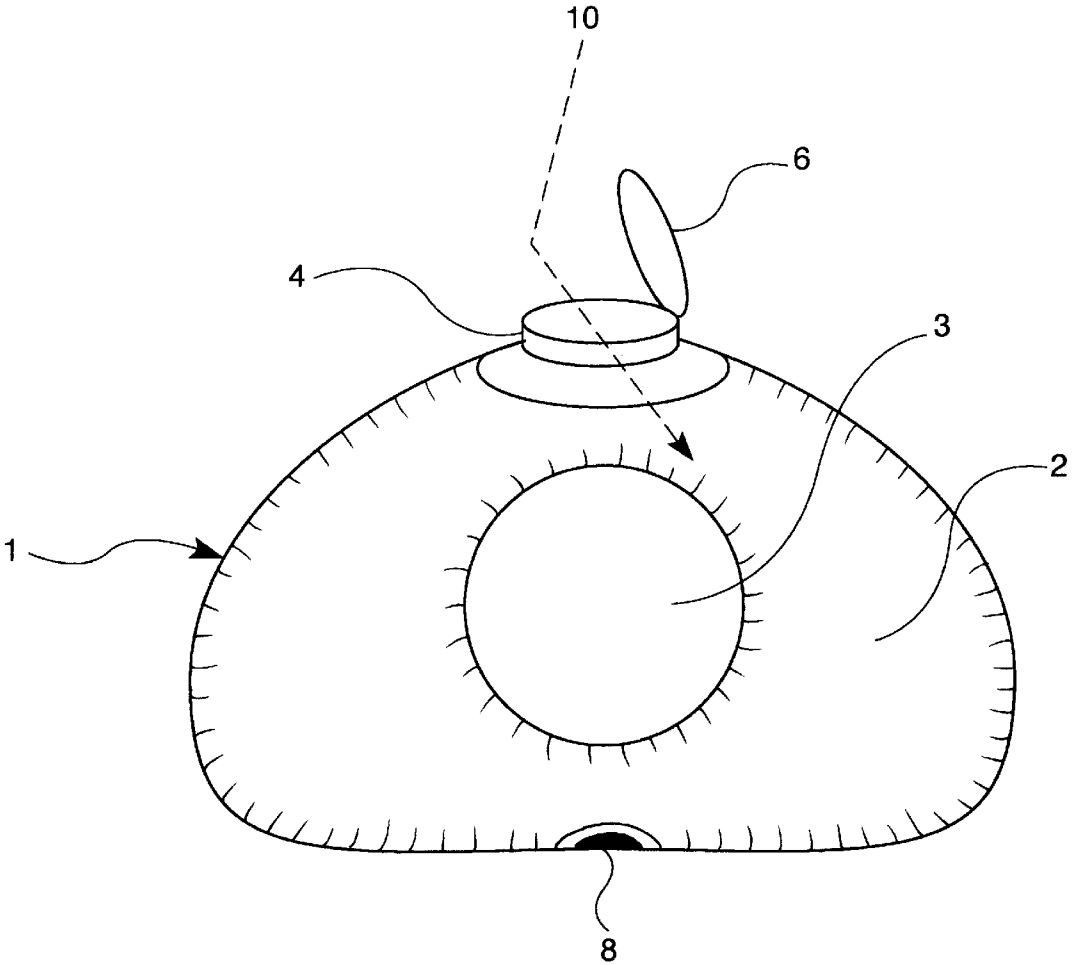
FIG. 2 is a perspective view of a bladder of the present invention illustrating its "pop-up" fill spout and its dispensing nozzle.

In FIG. 2, bladder 1 has a round donut-shaped body 2 defined by centrally located hole 3, and a pop-up fill spout 4 with recloseable lid 6 attached. At the base of body 2 is dispensing nozzle 8. Broken line 10 shows filling bladder 1 with liquid soap which may then be contained within body 2.

Figure 3:
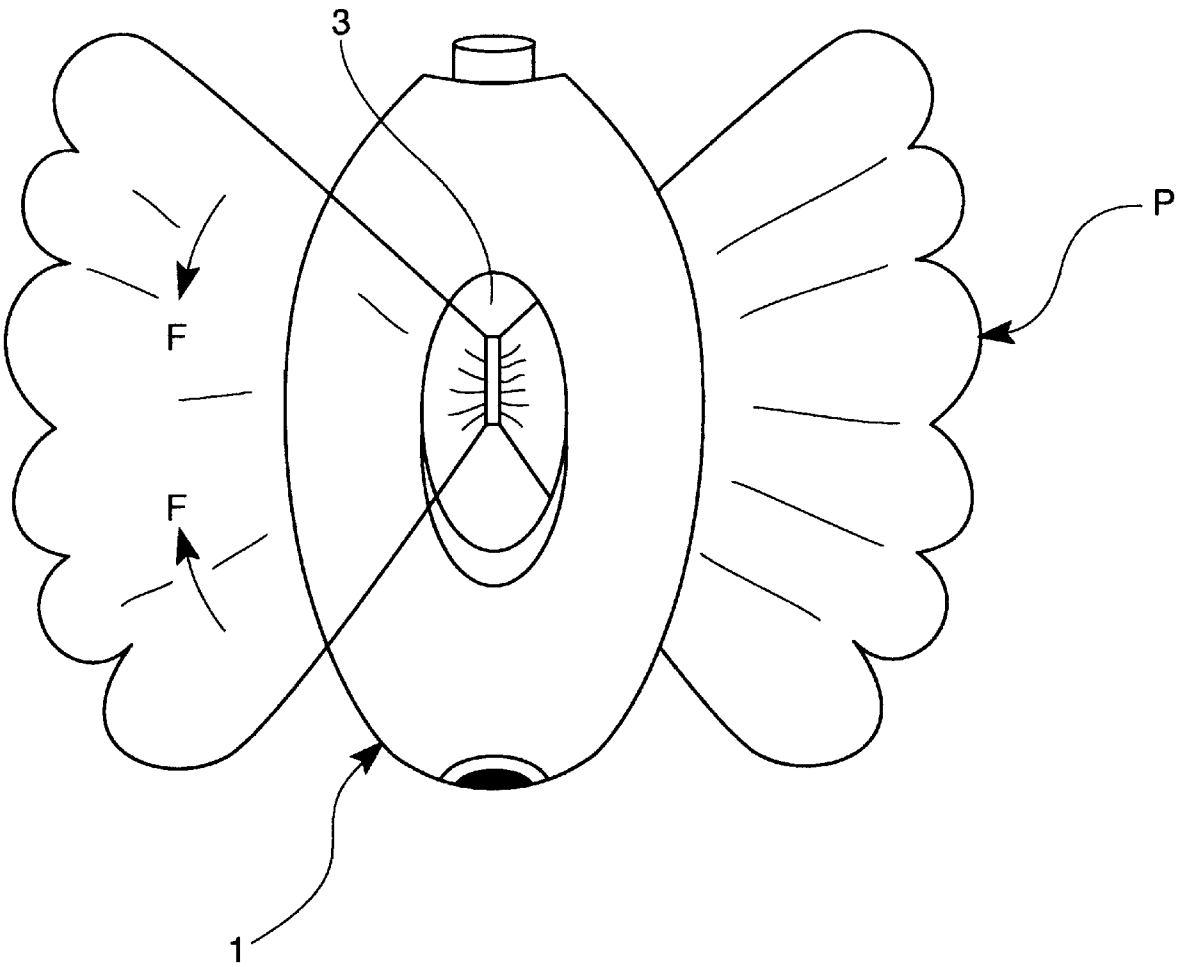
FIG. 3 is a perspective view of the prior art puff in FIG. 1 folded over in a manner to easily insert into the bladder of FIG. 2.

In FIG. 3, prior art puff P as shown in FIG. 1 is folded down upon itself as illustrated by arrows exerting folding motion F, and hence enabling puff P to be easily inserted through centrally located hole 3 of donut shaped bladder 1 (see FIG. 2).

Plastic scrubbing scrim P may be gathered to form a puff and may surround substantially all of the bladder except near the dispensing orifice 8 and retained thereby such that when the bladder 1 is squeezed, a liquid is dispensed through dispensing orifice in an area near the plastic scrubbing scrim.

Figure 4:
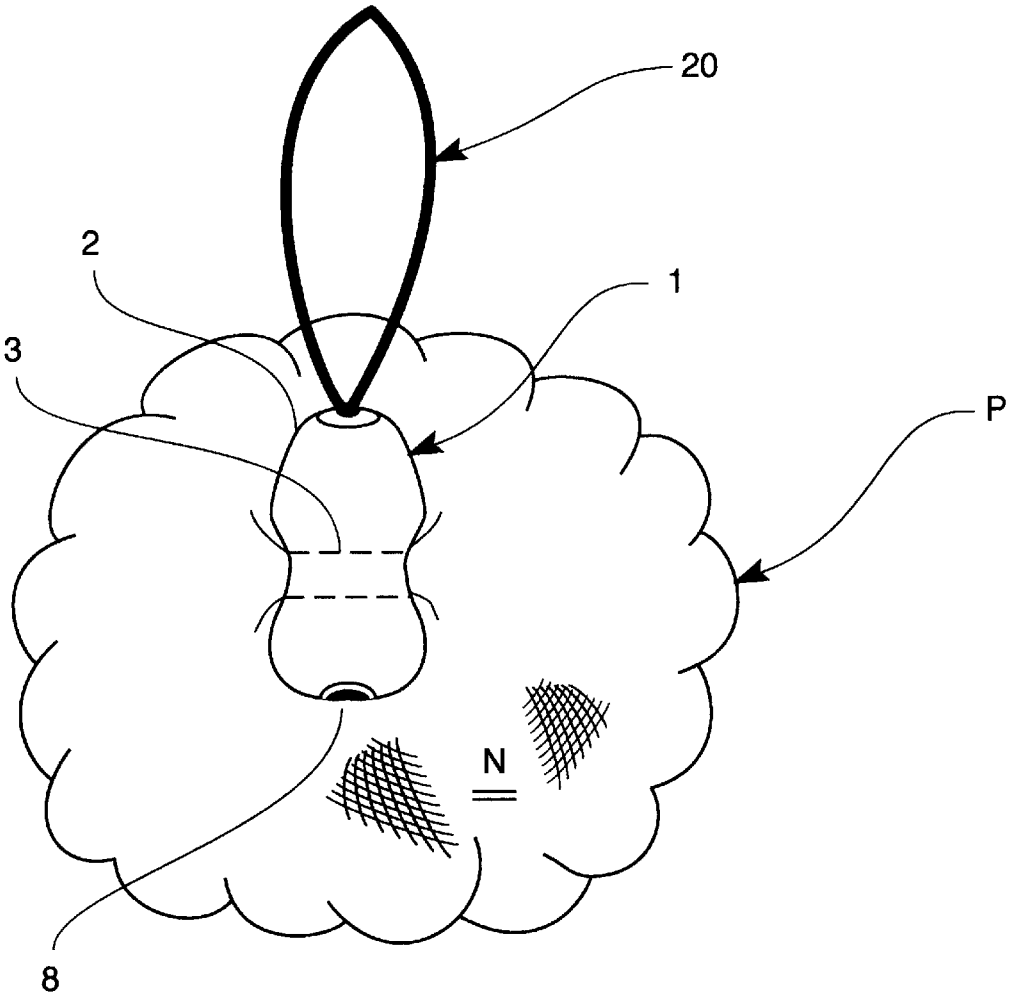
FIG. 4 is a perspective view of the bladder of FIG. 2 with the puff in FIG. 1 completely inserted and "fluffed out," ready for use.

In FIG. 4, prior art puff P which has been inserted through hole 3, is then fluffed out back to its natural shape which then naturally shapes itself around bladder 1. In this illustration, optional cord 20 has been attached to bladder 1. From this perspective it is easy to see how the bather can squeeze puff P in virtually any location and the force upon bladder body 2 will dispense liquid soap from nozzle 8 and into the plastic mesh N of puff P. Puff P then quickly and easily lathers up for a bather to apply to their skin.

Figure 5:
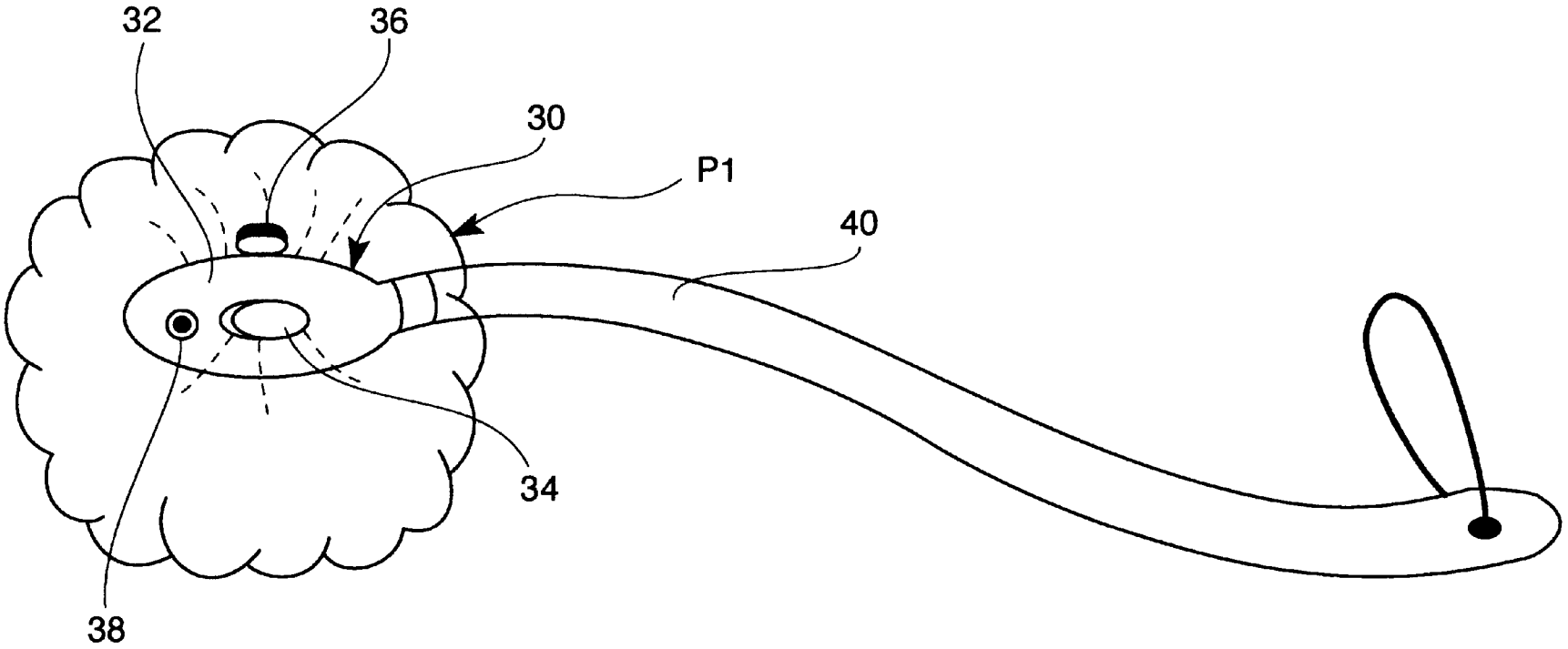
FIG. 5 is a perspective view of a bladder of the present invention in combination with a handle and its attached puff.

In FIG. 5, donut-shaped bladder 30 has a body 32, a centrally located hole 34, a filling spout 36 and a dispensing nozzle 38 and is much the same as the bladder of FIG. 2 except that bladder 30 is an integral part of handle 40. The attachment of puff P1 to bladder 30 is much the same as previously discussed in FIGS. 3 and 4, whereas puff P1 is folded upon itself and inserted through centrally located hole 34.

Figure 6:
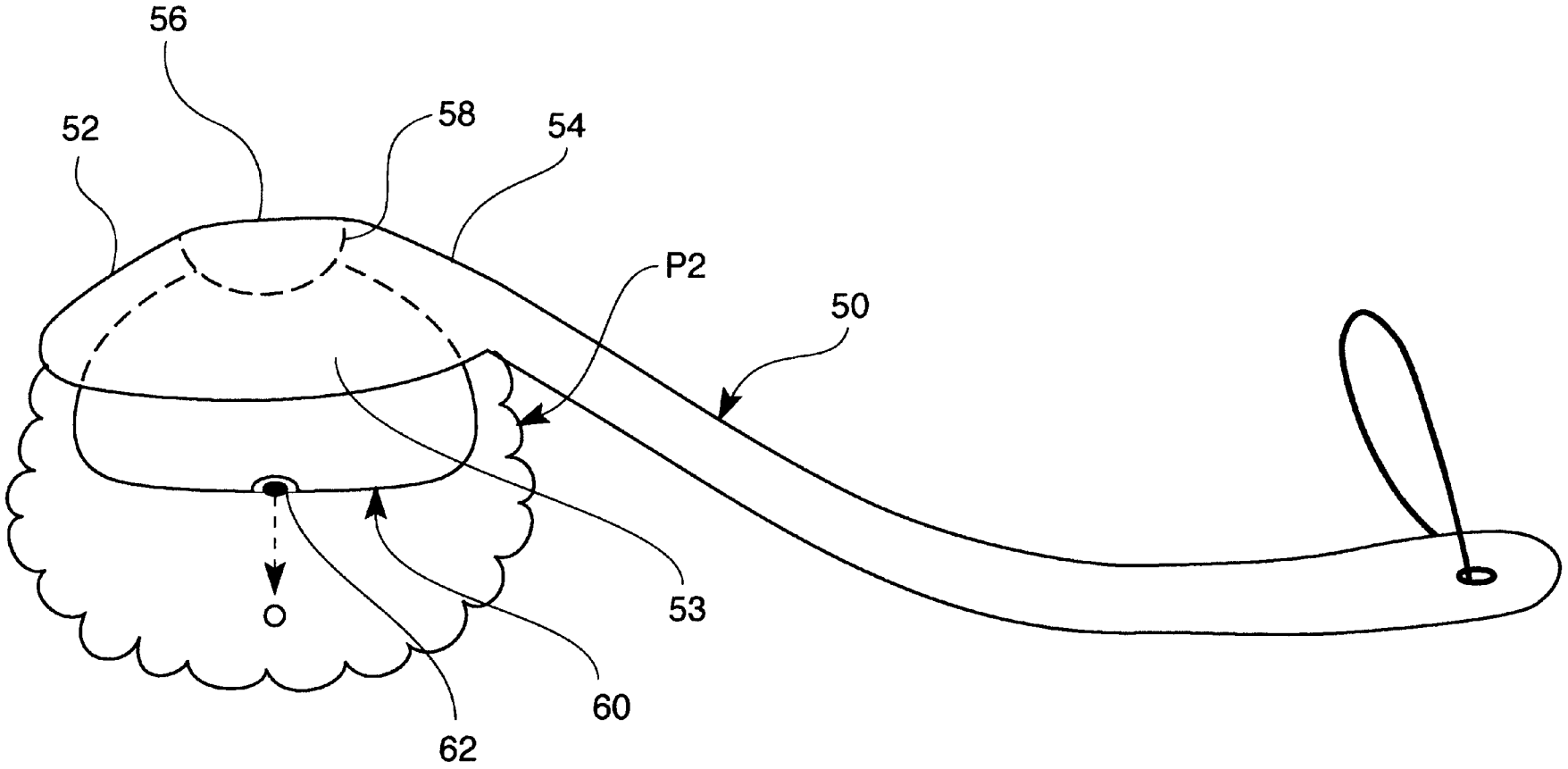
FIG. 6 is a perspective view of a variation of a bladder attached to a handle, in which the handle includes a means of allowing the bather to squeeze the bladder.

In FIG. 6, handle 50 has a spoon shaped end 53 defined by broken line 52 and 54. At the central location of spoon shaped end 53 is a hole 56 defined by broken line 58. Attached inside of spoon shaped end 53 is round bladder 60 which also has a fill spout (not shown) and a dispensing nozzle 62 pointed directly into puff P2. Through hole 56, the bather can access bladder 60 and by pushing with a finger, for instance, cause the forced dispensing of liquid soap through nozzle 62 and into puff P2.

Figure 7:
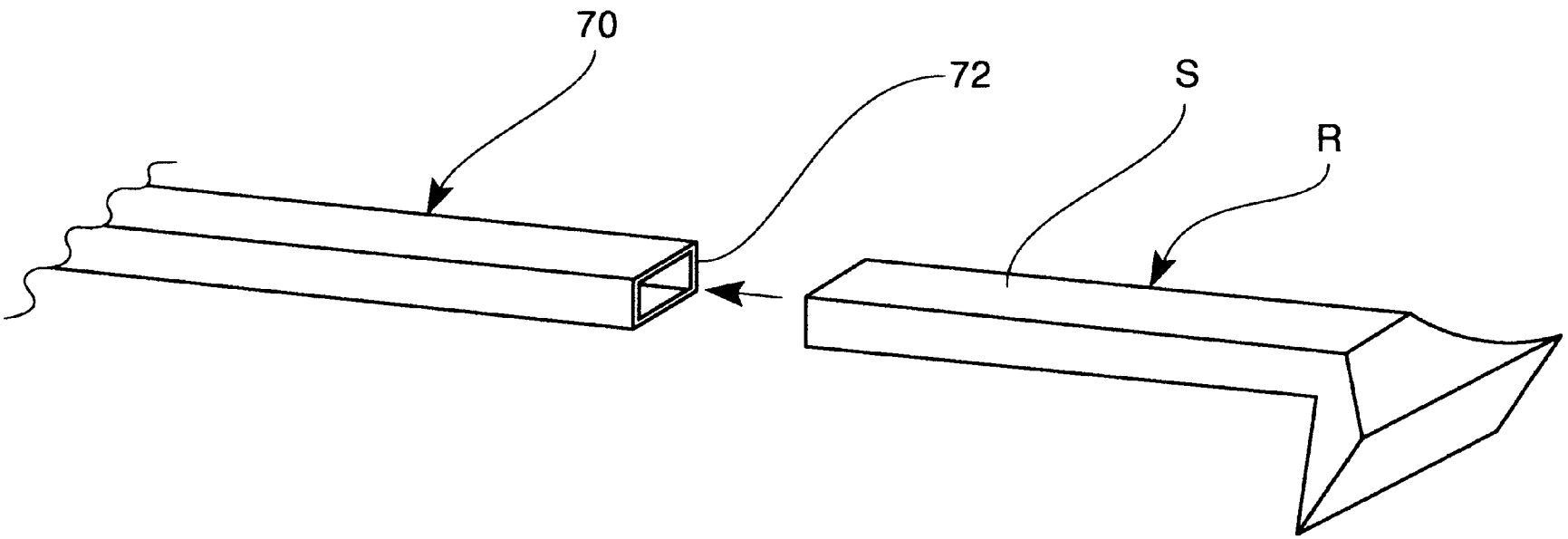
FIG. 7 is a perspective view of a handle with an open end for the insertion of a shaving razor.

FIG. 7 illustrates a handle 70 at the opposite end of the puff-bladder-handle combination much like that which can be used in the combinations of either FIGS. 5 and 6. Handle 70 has an open end 72 which is used for receiving the shaft S of prior art razor R as indicated by the arrow.

Figure 8:
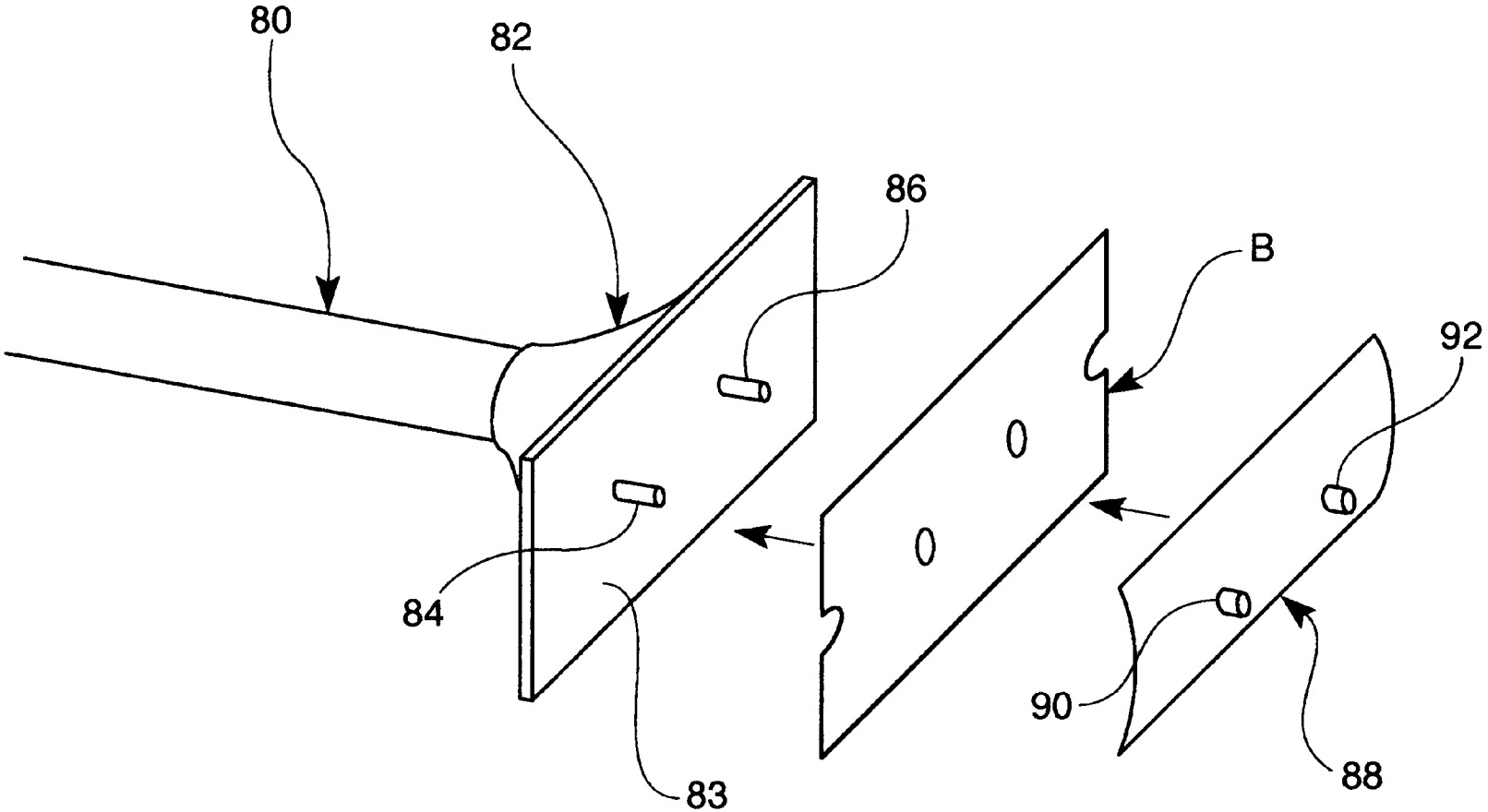
FIG. 8 is a perspective view of a handle with a means of attaching only the razor blade itself.

FIG. 8 is a variation of the opposite end of a handle as used in the combinations of FIGS. 5 and 6 in which handle 80 has a razor receptacle 82 at its end point. Razor receptacle 82 has a flat base 83 and two mounting studs 84 and 86. Razor receptacle also includes a top 88 (which is removed from receptacle 82) which has two female receptors 90 and 92. To secure prior art razor blade B into receptacle 82, razor B is mounted over studs 84 and 86 and then secured in place by placing top 88 over razor blade B and snapping the two female receptors 90 and 92 of top 88 firmly onto studs 84 and 86.

Understandably, one experienced in the art can devise different methods of dispensing soap from bladders and attaching them to the puffs or handles. It is the intention and the scope of the present invention under which all such methods fall.

For example, only one dispensing spout is illustrated in the preferred embodiment. However, additional dispensing spouts may be provided to allow soap or other liquid to be more evenly dispensed over the puff.

Similarly, many different means can be devised to attach razors to the ends of handles, but the intention and scope of the present invention does not limit the means to just those illustrated.

What is claimed is:

1. A liquid-dispensing puff comprising:

a donut-shaped bladder for containing a liquid, the donut-shaped bladder having a closable filling orifice for receiving the liquid and at least one dispensing orifice for dispensing the liquid when the donut-shaped bladder is squeezed; and a plastic scrubbing scrim, engaging through a central portion of the donut-shaped bladder and retained therein, said plastic scrim substantially enveloping the donut-shaped bladder such that when the donut-shaped bladder is squeezed, the liquid is dispensed through the at least one dispensing orifice onto the plastic scrubbing scrim.

2. The liquid-dispensing puff of claim 1, further comprising:

a handle, coupled to the donut-shaped bladder, said handle having sufficient length so as to allow a user to scrub a body extremity without reaching.

3. The liquid-dispensing puff of claim 2, wherein the handle is an integral portion of the donut-shaped bladder.

4. The liquid-dispensing puff of claim 3, further comprising:

a cord, attached to the donut-shaped bladder, for facilitating handling of the liquid-dispensing puff.

5. The liquid-dispensing puff of claim 2, wherein said handle further comprises a receptacle means, formed at an end opposite the donut-shaped bladder, for receiving a razor.

6. The liquid-dispensing puff of claim 5, wherein said receptacle means is shaped to accept a handle of a disposable razor.

7. The liquid-dispensing puff of claim 5, wherein said receptacle means is shaped to accept a razor blade.

8. A liquid-dispensing puff comprising:

a bladder for containing a liquid, the bladder having a closable filling orifice for receiving the liquid and at least one dispensing orifice for dispensing the liquid when the bladder is squeezed; and a plastic scrubbing scrim, gathered to form a puff and surrounding substantially all of the bladder except near the at least one dispensing orifice and the closable filling orifice and retained thereby such that when the bladder is squeezed, the liquid is dispensed through the at least one dispensing orifice.

9. The liquid-dispensing puff of claim 8, further comprising:

a handle, coupled to the bladder, said handle having sufficient length so as to allow a user to scrub a body extremity without reaching.

10. The liquid-dispensing puff of claim 9, wherein the handle is an integral portion of the bladder.

11. The liquid-dispensing puff of claim 10, wherein said handle further comprises a receptacle means, formed at an end opposite the bladder, for receiving a razor.

12. The liquid-dispensing puff of claim 11, wherein said receptacle means is shaped to accept a handle of a disposable razor.

13. The liquid-dispensing puff of claim 11, wherein said receptacle means is shaped to accept a razor blade.

14. The liquid-dispensing puff of claim 10, further comprising:

a cord, attached to the bladder, for facilitating handling of the liquid-dispensing puff.

15. A liquid-dispensing puff comprising:

a bladder for containing a liquid, the bladder having at least one dispensing orifice for dispensing the liquid when the bladder is squeezed; and a plastic scrubbing scrim, lathered to form a Puff and surrounding substantially all of the bladder except near the at least one dispensing orifice and the closable filling orifice and retained thereby such that when the bladder is squeezed, the liquid is dispensed through the at least one dispensing orifice.

16. The liquid-dispensing puff of claim 15, further comprising:

a handle, coupled to the bladder, said handle having sufficient length so as to allow a user to scrub a body extremity without reaching.

17. The liquid-dispensing puff of claim 16, wherein the handle is an integral portion of the bladder.

18. The liquid-dispensing puff of claim 16, wherein said handle further comprises a receptacle means, formed at an end opposite the bladder, for receiving a razor.

19. The liquid-dispensing puff of claim 18, wherein said receptacle means is shaped to accept a handle of a disposable razor.

20. The liquid-dispensing puff of claim 18, wherein said receptacle means is shaped to accept a razor blade.

21. A liquid-dispensing puff comprising:

a bladder for containing a liquid, the bladder having a closable filling orifice for receiving the liquid and at least one dispensing orifice for dispensing the liquid when the bladder is squeezed; and a plastic scrubbing scrim, gathered to form a puff and surrounding the bladder and retained thereby such that when the bladder is squeezed, the liquid is dispensed through the at least one dispensing orifice onto the plastic scrim.

22. The liquid-dispensing puff of claim 21, further comprising:

a handle, coupled to the bladder, said handle having sufficient length so as to allow a user to scrub a body extremity without reaching.

23. The liquid-dispensing puff of claim 22, wherein the handle is an integral portion of the bladder.

24. The liquid-dispensing puff of claim 23, wherein said handle further comprises a receptacle means, formed at an end opposite the bladder, for receiving a razor.

25. The liquid-dispensing puff of claim 24, wherein said receptacle means is shaped to accept a handle of a disposable razor.

26. The liquid-dispensing puff of claim 23, further comprising:

a cord, attached to the bladder, for facilitating handling of the liquid-dispensing puff.

27. A liquid-dispensing puff comprising:

a bladder for containing a liquid, the bladder having at least one dispensing orifice for dispensing the liquid when the bladder is squeezed; and a plastic scrubbing scrim, gathered to form a puff and surrounding the bladder and retained thereby such that when the bladder is squeezed, the liquid is dispensed through the at least one dispensing orifice onto the plastic scrubbing scrim.

28. The liquid-dispensing puff of claim 27, further comprising:

a handle, coupled to the bladder, said handle having sufficient length so as to allow a user to scrub a body extremity without reaching.

29. The liquid-dispensing puff of claim 28, wherein the handle is an integral portion of the bladder.

30. The liquid-dispensing puff of claim 28, wherein said handle further comprises a receptacle means, formed at an end opposite the bladder, for receiving a razor.

* * * * *

UNITED STATES PATENT AND TRADEMARK OFFICE

CERTIFICATE OF CORRECTION

PATENT NO. : 5,944,032
DATED : August 31, 1999
INVENTOR(S) : Masterson, Kelly Ann It is certified that error appears in the above-identified patent and that said Letters Patent is hereby corrected as shown below:

Column 5,
Lines 26-36, please change claim 15 to read as follows:

15. A liquid-dispensing puff comprising:

a bladder for containing a liquid, the bladder having at least one dispensing orifice for dispensing the liquid when the bladder is squeezed; and a plastic scrubbing scrim, lathered to form a Puff and surrounding substantially all of the bladder except near the at least on dispensing orifice and retained thereby such that when the bladder is squeezed, the liquid is dispensed through the at least one dispensing orifice.

Signed and Sealed this

Twenty-ninth Day of July, 2003

JAMES E. ROGAN
*Director of the United States Patent and Trademark Office*